United States Patent [19]

Vonderau et al.

[11] Patent Number: 4,903,655

[45] Date of Patent: Feb. 27, 1990

[54] MEMBRANE FUEL PUMP WITH PULSE DAMPENER

[75] Inventors: Werner Vonderau, Backnang; Hans Holderle, Freiberg; Armin Speckens, Waiblingen; Jürgen Wolf, Stuttgart, all of Fed. Rep. of Germany; Roger Simons, Virginia Beach, Va.

[73] Assignee: Andreas Stihl, Waiblingen, Fed. Rep. of Germany

[21] Appl. No.: 354,749

[22] Filed: May 22, 1989

[30] Foreign Application Priority Data

May 21, 1988 [DE] Fed. Rep. of Germany ..... 3817404

[51] Int. Cl.[4] ..... F02B 77/00

[52] U.S. Cl. ..... 123/198 C; 123/DIG. 5; 261/35; 417/540

[58] Field of Search ..... 123/73 C, 198 C, 510, 123/DIG. 5; 417/380, 395, 540; 261/35, DIG. 8

[56] References Cited

U.S. PATENT DOCUMENTS 3,170,005 2/1965 Phillips ..... 261/35

4,552,101 11/1985 Borst et al. ..... 123/DIG. 5

4,594,971 6/1986 Borst ..... 123/DIG. 5

*Primary Examiner*—Noah P. Kamen

*Attorney, Agent, or Firm*—Walter Ottesen

[57] ABSTRACT

The invention is directed to a membrane fuel pump for an internal combustion engine equipped with a membrane carburetor. The engine is that of a working apparatus and especially a handheld portable tool such as a motor-driven chain saw or the like. The membrane pump includes a drive chamber charged with the pressure inside the crankcase of the engine and a pump chamber separated from the drive chamber by a membrane. The pump chamber is connected at its suction end to a fuel tank via a first check valve and is connected to a pressure controller of the membrane carburetor at its pressure end via a second check valve. The pressure end of the membrane pump is connected with the suction end thereof via a bypass and a throttle is mounted in this bypass. With the throttle bypass between the pressure end and the suction end, the pumped volume is reduced at idle and the pump pressure is smoothed. Disturbances at the membrane carburetor are avoided.

8 Claims, 3 Drawing Sheets

MEMBRANE FUEL PUMP WITH PULSE DAMPENER

FIELD OF THE INVENTION

The invention relates to a membrane fuel pump for an engine of a work apparatus especially for a handheld portable tool such as a motor-driven chain saw.

BACKGROUND OF THE INVENTION

A membrane fuel pump of this kind is driven as a pulse pump by the changing pressure in the crankcase of the engine and is utilized, for example, with internal combustion engines of motor-driven chain saws. When an underpressure is present in the crankcase, the membrane of the fuel pump bends in the direction of a volume reduction of the drive chamber and a corresponding volume increase of the pump chamber whereby fuel is drawn by suction via the first check valve into the pump chamber. With the overpressure condition which follows, the membrane is deflected in the sense of a volume increase of the drive chamber and a corresponding volume reduction of the pump chamber whereby fuel is pumped via the second check valve on the pressure end of the pump to the membrane carburetor.

Since the pressure in the crankcase fluctuates approximately between −0.2 and 0.6 bar in dependence upon rotational speed, the feed pressure at the pressure end of the membrane fuel pump also fluctuates. For this reason, a pressure regulator is provided ahead of the entrance into the carburetor which in intended to compensate for large pressure fluctuations. From the control chamber of the pressure controller, a main nozzle channel leads into the intake pipe of the engine via a main nozzle and a check valve. An idle nozzle channel conducts fuel from the control chamber via an idle nozzle into the intake pipe.

A low underpressure must develop in the control chamber in order to hold the check valve of the main nozzle closed so that a fuel feed into the venturi section of the intake pipe is obtained exclusively via the idle nozzle channel.

In practice, it has been shown that for external accelerations acting on the control system in idle, the pressure controller cannot equalize the large pressure fluctuations of the fuel pump to the extent that the underpressure in the control chamber is obtained which is required for a reliable closure of the check valve of the main nozzle. For this reason, positive pressures in the control chamber develop also at idle whereby fuel comes out of the main nozzle (main nozzle dripping) and the mixture drawn in by suction becomes intensely overrich thereby causing the engine to die.

SUMMARY OF THE INVENTION

It is an object of the invention to provide a membrane carburetor supplied from a membrane fuel pump wherein large pressure fluctuations in the control chamber are prevented in order to prevent dripping from the main nozzle during idle.

The membrane fuel pump is for an internal combustion engine for a work apparatus and especially for a handheld, portable tool such as a motor-driven chain saw and the like. The engine has a piston and a cylinder conjointly defining a combustion chamber and has a crankcase wherein pressure is developed in response to the movement of the piston. The engine is equipped with a fuel tank and a carburetor having a pressure controller. The membrane fuel pump according to the invention includes: a housing defining an enclosed space; a membrane partitioning the enclosed space into a drive chamber communicating with the crankcase so as to be charged with the pressure therein and a pump chamber; the pump chamber having a suction end connected to the fuel tank and a pressure end connected to the pressure controller of the carburetor; first check valve means interposed between the suction end and the fuel tank; second check valve means interposed between the pressure end and the pressure controller of the carburetor; bypass means interconnecting said pressure end and the suction end for bypassing the pump chamber and passing fuel from the pressure end back to the suction end; and, throttle means arranged in the bypass means for throttling the flow of fuel passing through the bypass means.

At low rotational speed (idle speed), a volumetric flow of fuel flows back to the suction end via the bypass (for example, also directly into the fuel tank), so that the fuel pressure at the input of the pressure controller is significantly reduced and smoothed. A pump pressure reduced by approximately a factor of 10 is obtained as compared to no bypass. Also, pressure peaks occurring at low speed are reliably reduced via the bypass. The result is that during idle and at low speed in the range near idle, the pressure controller achieves a better control quality because of the attenuated input signal. In the control chamber, the required underpressure adjusts itself which assures as reliable closure of the check valve of the main nozzle. A dripping at the main nozzle during idle and the overenrichment of the mixture resulting therefrom is reliably prevented.

For increasing speed, the throttle functions evermore intensely and reduces the volumetric flow through the bypass. In contrast, pressure peaks can be further reduced via the bypass so that for increasing speed up to the highest speed, a substantially constant fuel pressure is present at the input to the pressure controller. The constant pump pressure obtained over a large range of rotational speed assures that a one-time best adjustment of the carburetor at, for example 8,000 rpm, will be substantially maintained over the entire speed range. The best adjustment can be achieved only downstream of the venturi of the carburetor and the adjusting throttles. An intensely fluctuating fuel pressure no longer influences the adjustment. In addition to an influenceable and more favorable fuel consumption, a substantially optimally adjusted mixture is obtained which assures a good combustion. The exhaust emission is therefore improved.

Pursuant to a further embodiment of the invention, the throttle is configured so as to be adjustable and preferably such that the throttle takes on higher throttling values in dependence upon the flow velocity. The feed pressure can be significantly reduced with this embodiment, especially for a pump having a high feed pressure at idle or in the speed range close to idle which is possible by means of a bypass having correspondingly large dimensions. At full load, there is nonetheless a complete usage of the entire feed volume at high feed pressure because of the large throttle values which self-adjust in proportion to volumetric flow. With a variable throttle, the pump feed pressure or the feed volume can be adapted to a predetermined curve over the rotational speed in a simple manner and this is independent of a continuous or discontinuous change of the throttle values.

In a simple manner, a variable throttle is configured as a throttle tongue projecting between a feed inlet and a flow-off outlet which preferably is part of the membrane sheet in which the pump check valve and the pump membrane are also configured.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
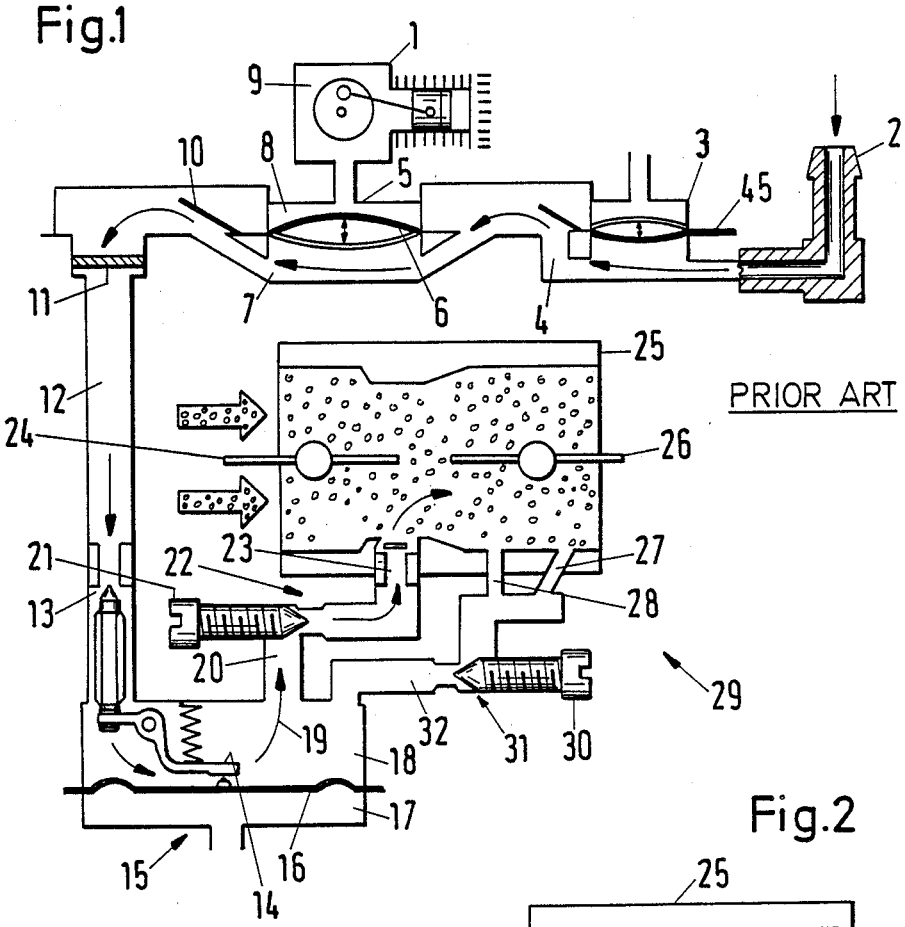
FIG. 1 is a schematic of a membrane fuel pump with a membrane carburetor connected thereto and shown in the full-load position.
Figure 2:
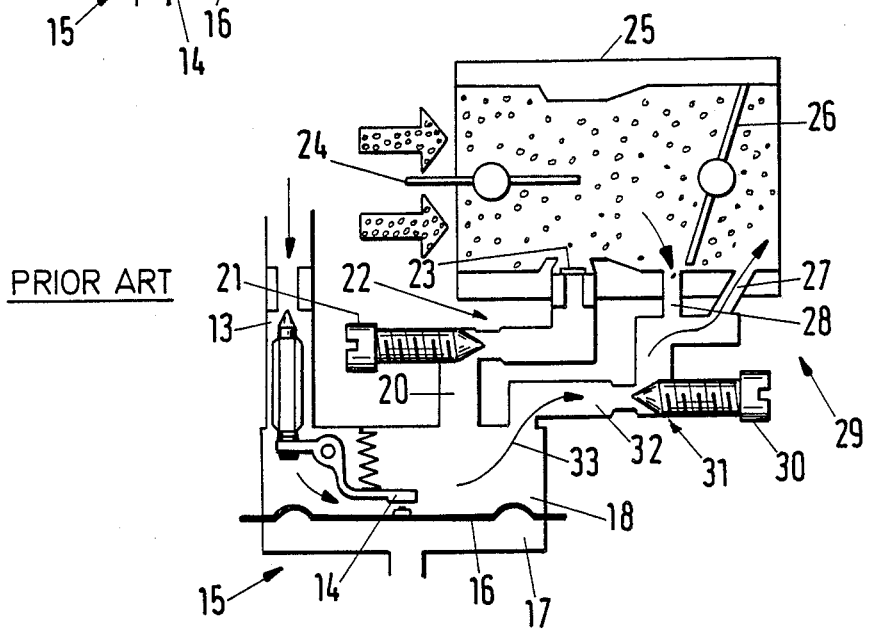
FIG. 2 is a schematic of a membrane carburetor of FIG. 1 shown at idle.

The membrane carburetor 29 shown in FIGS. 1 and 2 is especially for internal combustion engines of hand-held work tools such as motor-driven chain saws or the like. The membrane carburetor is supplied by a membrane fuel pump 5 via a pressure controller 15. The membrane fuel pump 5 draws fuel by suction from a fuel tank (not shown) and feeds the same to the pressure regulator 15. From the feed line 2 of the fuel tank, the fuel flows first into an equalization chamber 3 and from there via a check valve 4 into the pump chamber 7 of the fuel pump 5. The check valve 4 is configured as a flap valve as shown. The pump chamber 7 is separated from the drive chamber 8 of the fuel pump 5 by means of a membrane 6. The drive chamber 8 communicates with the crankcase 9 of a combustion engine 1 such as a two-stroke engine and is charged in this way by an alternating pressure within the crankcase.

If an underpressure is present in the drive chamber 8, the membrane 6 bends in the manner shown by the solid line whereby the volume of the drive chamber 8 is decreased and the volume of the pump chamber 7 is increased. Fuel is drawn by suction into the pump chamber 7 via the flap valve 4 which is now open.

If the pressure in the crankcase changes to positive pressure values, the membrane 6 snaps downwardly in the sense of a volume reduction of the pump chamber 7 and the fuel located in the pump chamber is charged with pressure. The flap valve 4 closes and a check valve 10 arranged at the pressure end of the pump 5 opens. The check valve 10 is likewise configured as a flap valve. The fuel is pumped through a fine filter 11 into the pressure line 12 to the pressure controller 15.

The pressure controller 15 is comprised essentially of a control chamber 18 which is separated by a control membrane 16 from a chamber 17 at atmospheric pressure. One end of the control lever 14 lies against the control membrane 16 at the center thereof while the other end of the lever controls a feed valve 13. The control lever 14 is resiliently biased in the sense of a closure of the feed valve 13 so that the inlet to the control chamber 18 is at first closed.

A main nozzle channel 20 leads from the control chamber 18 via a main nozzle 22 into the intake pipe 25 of the internal combustion engine 1. The opening cross section of the main nozzle 22 is adjustable by means of a control screw 21. A check valve 23 opening into the intake pipe is provided at the opening of the main nozzle channel 20 into the intake pipe 25. The opening of the main nozzle channel lies in the intake pipe between a starter flap 24 and a throttle flap 26 by means of which the pass-through cross section of the intake pipe 25 can be influenced.

In addition, an idle nozzle channel 32 leads from control chamber 18 via an idle nozzle 31 to the intake pipe 25. The opening cross section of the idle nozzle is also adjustable by means of a control screw 30. The idle nozzle channel 32 opens into the intake pipe 25 via an outlet channel 27 and at a location behind the throttle flap 26 when viewed in the direction of flow. A bypass channel 28 branches off from the idle nozzle channel and opens into the intake pipe 25 upstream of the throttle flap 26.

In the full-load position, that is for the condition wherein the intake pipe is fully opened, fuel is drawn by suction into the intake pipe 25 at the venturi section thereof via the main nozzle channel 20 (arrow 19) as well as via the idle nozzle channel 32. The underpressure which develops thereby in the control chamber 18 leads to a displacement of the control membrane 16 whereby the control lever 14 is actuated, the feed valve 13 opened and fuel under pressure flows into chamber 18.

The throttle flap 26 is closed in the idle position of the membrane carburetor shown in FIG. 2. Fuel should now enter the intake pipe 25 downstream of the throttle flap 26 exclusively through the idle nozzle channel 32 and the outlet channel 27 (arrow 33). The check valve 23 of the main nozzle channel 20 does not close completely because of the pressure fluctuations occurring in the control chamber 18. These pressure fluctuations are present because of the intensely fluctuating fuel pressure at the feed valve 13. For this reason, dripping at the main nozzle causes overenrichment of the idle mixture. The engine is brought to standstill because of the mixture which cannot be ignited.

Figure 3:
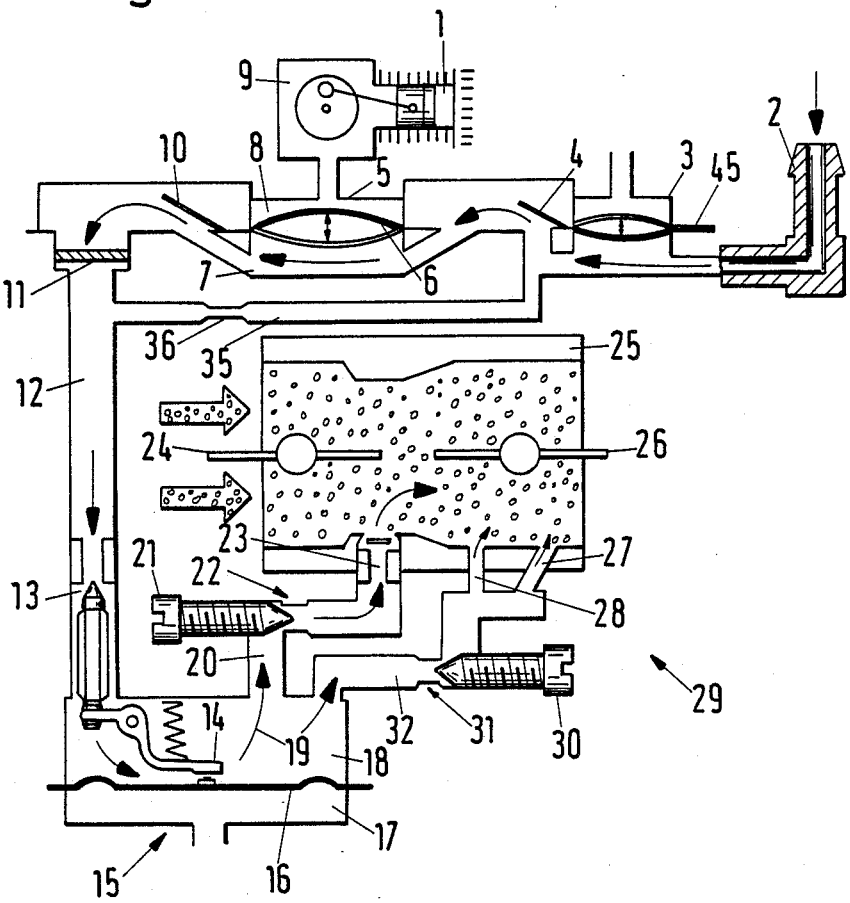
FIG. 3 is a schematic of an embodiment of a membrane fuel pump according to the invention having a bypass and a membrane carburetor connected thereto and shown in the full-load position.
Figure 5:
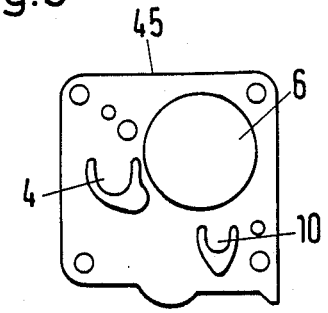
FIG. 5 is a plan view of a membrane sheet for a fuel pump according to FIG. 1; and, FIG. 6 is a plan view of the membrane sheet according to FIG. 5 with an integrated variable throttle according to FIG. 4*a*.

The embodiment of the invention shown in FIG. 3 includes a bypass 35 in which a throttle 36 is provided. The bypass connects the pressure end of the pump 5 downstream of the flap valve 10 and preferably downstream of the fine filter 11 with the suction end of the pump upstream of the flap valve 4. The bypass is seen as a pump short circuit. A portion of the pump capacity is drawn off from the pressure line 12 and pumped in a circle; that is, it is again supplied to the suction end, for example, into the fuel tank. With an appropriate configuration of the throttle 36, a larger pumped volumetric capacity component is return-pumped through the bypass 35 at lower rotational speed (idle) so that only a small volume at low pressure flows to the feed valve 13. The pumping capacity is significantly reduced. The reduced pumped volume is substantially free of pressure peaks since pressure peaks are also reduced via the bypass according to the invention. In this way, the controller 15 can adjust an underpressure in the control chamber 18 during idle (FIG. 2) with the underpressure being substantially free of fluctuations thereby assuring a reliable closure of the check valve 23 of the main nozzle channel. Dripping at the main nozzle and thereby an overenrichment of the idle mixture is avoided.

The action of the throttle 36 commences for increasing speed and at the highest speed. No significant component of the pumped volume is pumped in circulation so that substantially the entire pumped volume is present at the feed valve 13 to cover the fuel requirements at full load (FIG. 3). The bypass, however, continues to assure the reduction of pressure peaks at the pressure end of the pump so that the control pressure which adjusts in the control chamber 18 is substantially free of pressure fluctuations.

An approximately constant pump pressure is maintained over the speed range because of the dimensioning of the bypass. This effect is positive for the metering of fuel over the entire speed range. A one-time best adjustment of the carburetor at 8,000 rpm, for example, is also substantially maintained at low speeds since the pump pressure does not change. A pump-dependent overenrichment or leaning of the mixture in different ranges of rotational speed no longer occurs as must be tolerated with known carburetors.

Figure 4:
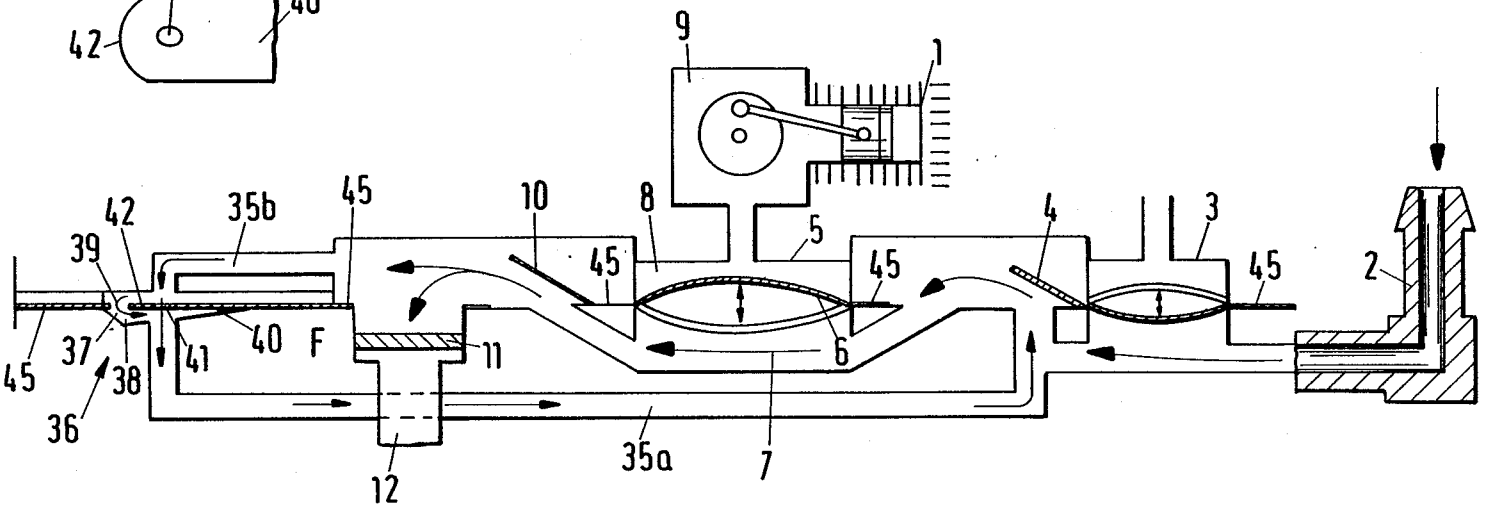
FIG. 4 is a schematic of another embodiment of the membrane fuel pump according to the invention with a variable throttle mounted in the bypass.
Figure 4A:
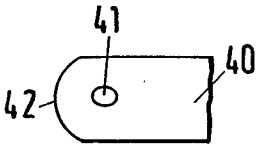
FIG. 4*a* is a plan view of the variable throttle.

A further embodiment of the invention is shown in FIG. 4 wherein the throttle 36 of the bypass is configured so as to be variable. The configuration of the fuel pump shown in FIG. 4 corresponds approximately to that shown in FIG. 3; however, the throttle 36 now lies in the plane of the membrane sheet 45 in which the following are also formed: flap valves (4, 10), the membrane of the equalizing chamber 3 and the pump membrane 6. The bypass includes a throttle chamber 37 which is connected via the channel segment **35*b* with the pressure end of the pump 5 and via the channel segment 35*a* with the suction end of the pump. A flexible throttle tongue 40 projects into the throttle chamber 37 and a throttle aperture 41 is formed in the tongue. The aperture 41 lies in the direction of flow approximately in the center in the channel cross section of the bypass (35*a*, 35*b*). The free end 42 of the tongue 40 projects freely into the throttle chamber 37 and the fuel flows around this tongue in the direction of the arrow 39**.

At idle and in the speed range near idle, a considerable fuel volume is simply recirculated so that the feed rate of the pump which is pumped into the pressure line 12 is only very little and has a low pressure. In the throttle chamber 37, the recirculated fuel volume flows in the direction of arrow 39 through the throttle gap around the free end 42 of the throttle tongue 40 as well as through its aperture 41.

If the rotational speed of the engine 1 increases, and therewith the flow velocity of the pumped fuel, the latter would take the throttle tongue 40 along in the downward direction when passing through the throttle gap until the tongue comes into tight contact engagement against the base 38 of the throttle chamber 37. Now, only the throttle aperture 41 determines the performance of the bypass. The fuel volume pumped back through the bypass is now significantly less so that the fuel volume pumped into the pressure line significantly increases. At high speed and at the highest speed, the throttle aperture retards the fuel flow through the bypass such that the maximum possible pumped volume of the pump for feeding the pressure line is fully utilized.

Since the bypass is always open to reduce pressure peaks independent of the speed, the fuel pressure in the pressure line to the feed valve 13 of the pressure controller 15 is made uniform. A substantially constant fuel pressure self-adjusts at high speeds and at the highest speeds.

Figure 6:
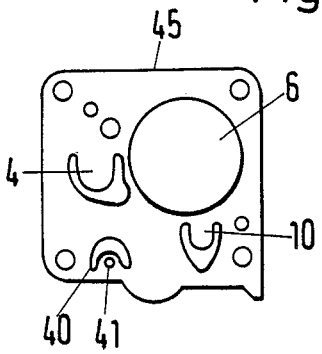

In a simple embodiment of the invention, the throttle tongue 40 defining the throttle 36 is provided in the membrane sheet 45 (FIG. 6) in which the following have already been provided: the flap valves (4, 10), the membrane of the equalizing chamber and the membrane 6 of the fuel pump. As shown in FIGS. 1 and 3 and especially in FIG. 4, the membrane sheet 45 is disposed at a partition plane of the fuel pump 5.

It is understood that the foregoing description is that of the preferred embodiments of the invention and that various changes and modifications may be made thereto without departing from the spirit and scope of the invention as defined in the appended claims.

What is claimed is:

1. A membrane fuel pump for an internal combustion engine for a work apparatus and especially for a handheld, portable tool such as a motor-driven chain saw and the like, the engine having a piston and a cylinder conjointly defining a combustion chamber and having a crankcase wherein pressure is developed in response to the movement of the piston, the engine being equipped with a fuel tank and a carburetor having a pressure controller, the membrane fuel pump comprising:

a housing defining an enclosed space;

a membrane partitioning said enclosed space into a drive chamber communicating with said crankcase so as to be charged with the pressure therein and a pump chamber;

said pump chamber having a suction end connected to the fuel tank and a pressure end connected to the pressure controller of the carburetor;

first check valve means interposed between said suction end and the fuel tank;

second check valve means interposed between said pressure end and the pressure controller of the carburetor;

bypass means interconnecting said pressure end and said suction end for bypassing said pump chamber and passing fuel from said pressure end back to said suction end; and, throttle means arranged in said bypass means for throttling the flow of fuel passing through said bypass means.

2. The membrane fuel pump of claim 1, wherein said bypass means is configured so as to define said throttle means.

3. The membrane fuel pump of claim 1, wherein said throttle means is pressure responsive.

4. The membrane fuel pump of claim 3, wherein said throttle means takes on higher throttle values with increasing flow velocity.

5. The membrane fuel pump of claim 4, said throttle means comprising: fixed throttle means; and, variable throttle means connected in parallel with said fixed throttle means.

6. The membrane fuel pump of claim 5, said throttle means comprising: a bypass channel formed in said housing so as to extend between said suction end and said pressure end; a throttle chamber connected into said bypass channel so as to define an inlet and an outlet through which the fuel in said bypass channel flows into and out of said throttle chamber, respectively; and, said variable throttle means being a flexible tongue projecting outwardly into said throttle chamber between said inlet and outlet so as to permit fuel flowing through said throttle chamber to flow around said flexible tongue.

7. The membrane fuel pump of claim 6, said fixed throttle means being an aperture formed in said flexible tongue.

8. The membrane fuel pump of claim 6, said housing having a partition interface for accommodating a membrane sheet wherein said flexible tongue is formed together with said first and second check valve means and said membrane partitioning said enclosed space.

* * * * *